United States Patent [19]

Seymour

[11] 4,055,278

[45] Oct. 25, 1977

[54] DISPENSING SHOWER HEAD

[75] Inventor: Joseph A. Seymour, Haverhill, Mass.

[73] Assignee: Lawrence Peska, Associates, Inc., New York, N.Y.

[21] Appl. No.: 717,132

[22] Filed: Aug. 24, 1976

[51] Int. Cl.[2] ..... B67D 5/60

[52] U.S. Cl. ..... 222/42; 222/132; 222/144.5; 239/315

[58] Field of Search ..... 222/144.5, 132, 305, 222/315, 316, 42; 239/315

[56] References Cited

U.S. PATENT DOCUMENTS

| | | | |
|---|---|---|---|
| 3,091,402 | 7/1963 | Palmer | 239/305 X |
| 3,463,361 | 8/1969 | Cook et al. | 222/144.5 |
| 3,482,740 | 12/1969 | Evans et al. | 222/144.5 X |

*Primary Examiner*—Stanley H. Tollberg
*Assistant Examiner*—Hadd Lane

[57] ABSTRACT

A dispensing shower head is disclosed comprising an enclosure adapted to be connected to a water supply, the enclosure having a container therein carrying a cartridge which may be rotated to present different bath preparations to a stream of water passing through a flow path in the enclosure and out of a shower head opening in one end of the enclosure.

7 Claims, 8 Drawing Figures

DISPENSING SHOWER HEAD

SUMMARY OF THE INVENTION

The present invention relates to a dispensing shower head comprising an enclosure for attachment to a water supply, said enclosure having an influent opening and an effluent opening, a flow path being provided between said influent and said effluent opening in said enclosure, a shower spray on said effluent opening, a container positioned in said flow path and secured to said enclosure, said container having side walls and an end wall positioned opposite said influent opening, said container also having an opening accessible through said enclosure, a plurality of port means in said container, said port means opening into said flow path, a cartridge removably insertable in said container through said container opening, a plurality of chambers in said cartridge each chamber registerable with one of said port means, said plurality of port means and said plurality of chambers being arranged so that when one of said port means is in registration with one of said chambers, the other of said port means is not in registration with the other of said chambers and said container side walls seal off the other of said chambers from said flow path.

The present invention also relates to a dispensing shower head comprising an enclosure for attachment to a water supply such as a shower fixture. The enclosure has an influent opening and an effluent opening, a flow path being defined between the influent opening and the effluent opening. A shower spray is positioned on the effluent opening of the enclosure and a container is positioned in the flow path, the container being secured to the enclosure. The container comprises container side walls and a container end wall positioned opposite the influent opening of the enclosure A container opening is provided which is accessible through the enclosure. A first port member is positioned in the container, the first port opening into the flow path, a second port member also being provided in the container, the second port also opening into the flow path. A cartridge is removably insertable in the container through the container opening, the cartridge having a first chamber registerable with the first port member and a second chamber registerable with the second port member. The first and second port members and the first and second chambers are arranged so that when the first port is in registration with the first chamber, the second port is not in registration with the second chamber and the container side walls seal off the second chamber from the flow path. Additionally, when the second port is in registration with the second chamber, the first port is not in registration with the first chamber and the container side walls seal off the first chamber from the flow path.

The container may be cylindrically shaped and the container is positioned in the enclosure so that the longitudinal axis of the container passing through the container end wall and the container opening is substantially parallel to the flow path. The first port member and the second port member are positioned in the side walls of the container. In this embodiment, the cartridge is cylindrical and rotatably mounted in the container so that the longitudinal axis of the cartridge and the longitudinal axis of the cylinder are substantially in registration with one another. With this arrangement, the first chamber is rotatable to register with the first port and the second chamber is rotatable to register with the second port.

The first chamber may extend through the cartridge into two first chamber openings in the cartridge and the second chamber extends through the cartridge into two second chamber openings in the cartridge. The first port member comprises openings registerable with the two first chamber openings and the second port member openings also comprise openings registerable with the two second chamber openings.

The first chamber may be positioned axially in back of the second chamber.

The first chamber may be in a first section of the cartridge detachably securable to a second section of the cartridge containing the second chamber.

Indicator members may be provided on the cartridge for indicating when the first port and the first chamber are in registration and also for indicating when the second port and the second chamber are in registration.

The indicator may comprise a reference marker on the face of the cartridge facing the container opening, the reference marker being rotatable to reference points on the enclosure.

DETAILED DESCRIPTION OF THE PREFERRED EMBODIMENT

Dispensing shower heads are disclosed in the prior art U.S. Pat. Nos. 3,653,544 Turben; 3,623,638 Henning, et al; 3,614,244 Eck; 3,231,200 Heald; 3,199,788 Davis; 3,106,345 Wukowitz; 2,562,415 Chase; 2,316,781 Fox and 2,189,936 Brandfon.

The aforementioned prior art U.S. patents although teaching dispensing devices for showers are limited to the dispensing of one compound into a shower head. Where the dispensing of bath oils and various soaps or synthetic detergents is to be effected with this type of device, selection of individual compounds for different stages of the bath or for different preferences within a family cannot be achieved without dismanteling and recharging the devices.

It is therefore an object of the present invention to overcome these and other difficulties encountered in the prior art.

It is also an object of the present invention to provide a novel dispensing shower head for dispensing any one of a plurality of bath preparation individually from a shower head without having to dismantle the apparatus and recharge it for each different compound that is to be dispensed.

These and other objects have been achieved according to the present invention and will become apparent from the disclosure and claims that follow as well as the appended drawings.

Figure 1:
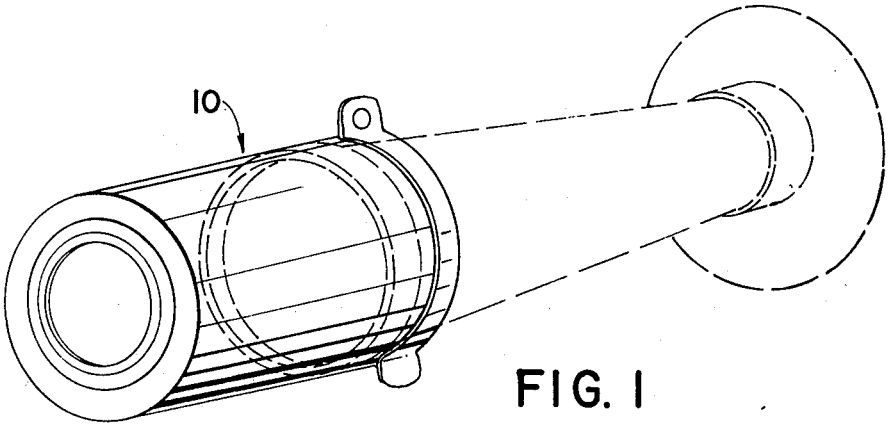
FIG. 1 is a perspective view of a dispensing shower head connected to a shower outlet according to one embodiment of the present invention.
Figure 2:
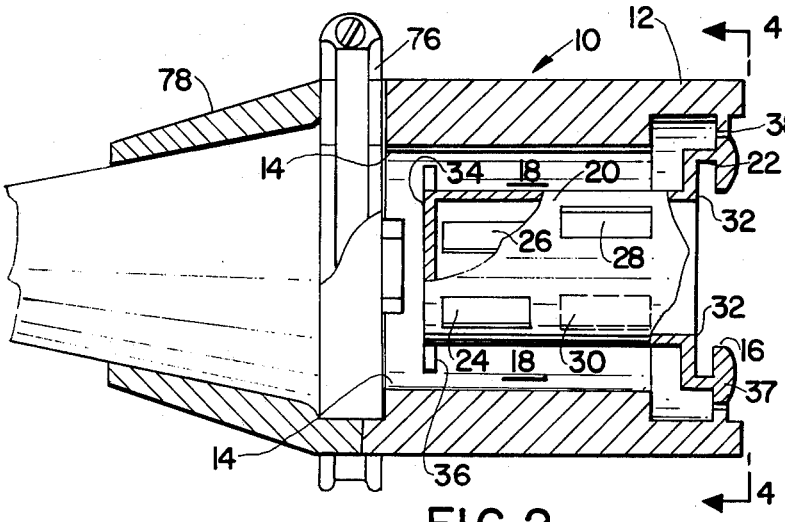
FIG. 2 comprises a side elevation in section illustrating a dispensing shower head attached to a water supply in which the dispensing shower head comprises an enclosure, a container mounted within the enclosure and a cartridge having chambers for two different bath preparations insertable into the container so that water passing through a flow path in the enclosure can be selectively directed over one of the bath preparations according to one embodiment of the present invention.
Figure 5:
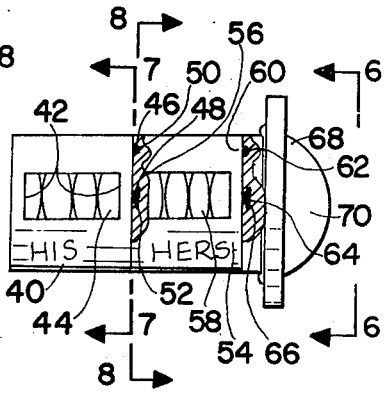
FIG. 5 comprises a cartridge insertable into a container positioned in an enclosure of a dispensing shower head in which the cartridge has two separate chambers for different bath preparations to be separately dispensed through a dispensing shower head according to yet another embodiment of the present invention.
Figure 6:
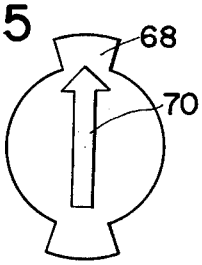
FIG. 6 comprises a front elevation taken along the line 6—6 of from FIG. 5.
Figure 3:
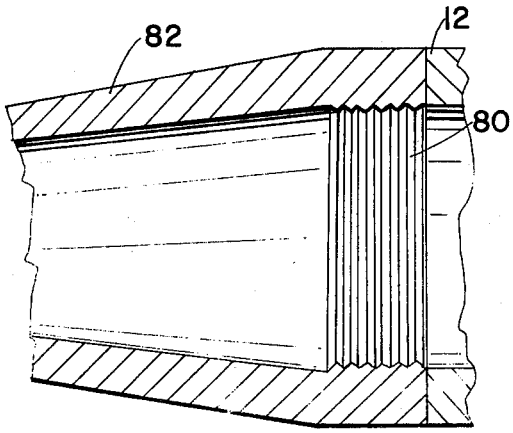
FIG. 3 is a partial side elevation in section illustrating an alternate method for attaching a dispensing shower head enclosure to a water supply according to another embodiment of the present invention.
Figure 4:
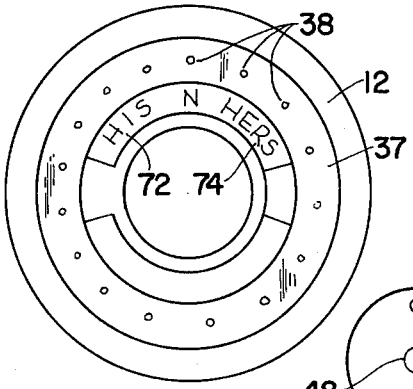
FIG. 4 comprises a front elevation taken along the line 4—4 from FIG. 2.
Figure 7:
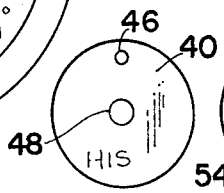
FIG. 7 comprises a front elevation taken along the line 7—7 of FIG. 4.
Figure 8:
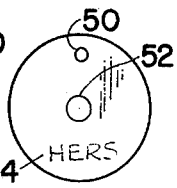
FIG. 8 comprises a front elevation taken along the line 8—8 of FIG. 4.

Referring to the drawing, and FIGS. 1–7, a dispensing shower head 10 is illustrated comprising an enclosure 12 for attachment to a water supply such as a shower fixture 78 or 82. Enclosure 12 is securable to the fixture 78 by means of a collar 76 which clampingly secures enclosure 12 to fixture 78 or by means of a threaded extension 80 extending from enclosure 12 into a threaded section of a water supply such as a shower fixture or shower head 82. An influent opening 14 and an effluent opening 16 are provided in the enclosure 12 and a flow path 18 is arranged in between the influent and effluent openings. A shower spray comprising openings 38 are positioned on a collar 37 inside of opening 16 and are arranged around the periphery of effluent opening 16. A container comprising side wall 20 integral with end wall 34 is positioned in the flow path 18 and is secured to the enclosure 12, the container comprising container side walls 20 and a container end wall 34 positioned opposite the influent opening 14. A baffle plate 36 extends around the end wall 34 for causing fluid turbulence within the flow path 18. The container comprising side wall 20 and end wall 34 is positioned in the enclosure 12 so that the longitudinal axis of such container passing through the container end wall 34 and the container opening 32 is substantially parallel to the flow path 18 in enclosure 12. In one embodiment, the container comprises a cylindrically shaped container having a round end wall and a hollow cylinder side wall 20. First port openings 24 and 26 are provided in container wall 20 opening into flow path 18 and second port members 28 and 30 are also provided in container wall 20 opening into flow path 18. A cartridge such as a cylindrical cartridge as illustrated in FIG. 4 is insertable through opening 32 into the container comprising container wall 20 and end wall 34. The cartridge in one embodiment comprises a cylindrical member 40 having a chamber 42 therein for containing a solid bath composition 44, cartridge 40 being detachably securable to a cylindrical cartridge 54 by means of a snap 48 and a boss 46 positioned thereon, snap 48 arranged for engagement with snap receiving detent 52 and detent 50 being arranged for receiving boss 46. Cylindrical cartridge 54 has a chamber 56 therein for containing a second type of bath composition 58 different from the composition 44 in chamber 42. Cartridge 54 in turn is removably securable to a disc 68 having an indicator 70 thereon for registration with indicia 72 and 74 on the face of flange 37. Cartridge 54 is securable to disc 68 by means of a snap 64 that is received by snap receiving detent 66 on disc 68 and a boss 60 which is received by detent 62 on disc 68. The first chamber 42 is positioned axially in back of the second chamber 56. The first chamber 42 extends through the cartridge 40 into a pair of first openings in the cartridge whereas the second chamber 56 extends through the cartridge 54 into a pair of two second chamber openings in the cartridge.

The cartridge assembly comprising cartridge 40 releasably secured to cartridge 54 is cylindrically and rotatably mounted in the container so that the longitudinal axis of the cartridge assembly and the longitudinal axis of the container are substantially in registration with one another.

The port openings 24 and 26 are registerable with the pair of chamber openings in chamber 42 and the port openings 28 and 30 are registerable with the pair of second chamber openings of chamber 56. The arrangement of port openings 24 and 26 as well as port openings 28 and 30 are such that when the port openings 24 and 26 are in registration with the openings in the chamber 42, the port openings 28 and 30 are not in registration with the openings in chamber 56 and the container side wall 20 seals off the chamber 56 from the flow path 18. Conversely, when the port openings 28 and 30 are in registration with the openings of chamber 56, the port openings 24 and 26 are not in registration with the openings of chamber 42 and the container side walls 20 seal off the chamber 42 from the flow path 18.

In use, cartridges 40 and 54 are snapped into place against one another and then into place on disc 68 which comprises a flexible plastic disc and the assembled cartridge inserted into the flanged opening 16. Enclosure 12 and opening 16 projecting from the effluent end thereof are made of a flexible plastic material such as polypropylene as is disc 68. Any of the art known equivalents of polypropylene may also be used such as nylon and the like. Cartridge 40 contains a bath preparation 44 in chamber 42 whereas a different bath preparation 58 is contained in chamber 56 of cartridge 54. Either bath preparation is brought into exposure to water passing through the flow path 18 of enclosure 12 by rotating disc 68 by means of indicator knob 70. Knob 70 is aligned either with indicia 72 or 74 to bring the openings of chamber 42 into registration with the ports 24 and 26 while sealing off the openings of chamber 56 against wall 20 and conversely, rotation of the indicator 70 to indicia 74 will bring the openings of chamber 56 into registration with the openings 28 and 30 in side wall 20 whereas the openings of chamber 42 will be sealed off by side wall 20. This arrangement of openings allows for the selection of individual bath compounds and a degree of selection is thereby provided which is not available with the aforementioned prior art devices. After the water is turned on in water supply 78, the water passes through the flow path 18 and over the baffle plate 36 causing turbulent flow through either of the openings 24, 26 or the alternate openings 28 and 30 mixing respectively with either the compound 44 or the compound 58 in chambers 42 and 56.

Although the invention has been described by reference to some embodiments, it is not intended that the novel dispensing shower head be limited thereby but that modifications thereof are intended to be included as falling within the broad spirit and scope of the foregoing disclosure, the following claims and the appended drawing.

I claim:

1. A dispensing shower head comprising an enclosure for attachment to a water supply, said enclosure having an influent opening and an effluent opening, a flow path being provided between said influent and said effluent opening in said enclosure, a shower spray on said effluent opening, a container positioned in said flow path and secured to said enclosure, said container having side walls and an end wall positioned opposite said influent opening, said container also having an opening accessible through said enclosure, a plurality of port means in said container, said port means opening into said flow path, a cartridge removably insertable in said container through said container opening, a plurality of chambers in said cartridge each chamber registerable with one of said port means, said plurality of port means and said plurality of chambers being arranged so that when one of said port means is in registration with one of said chambers, the other of said port means is not in registration with the other of said chambers and said container side walls seal off the other of said chambers from said flow path, said container is cylindrically shaped and said container is positioned in said enclosure so that the longitudinal axis of said container passing through said container end wall and said container opening is substantially parallel to said flow path, said port means are positioned in the side wall of said container, said cartridge is cylindrically shaped and rotatably mounted in said container so that the longitudinal axis of said cartridge and the longitudinal axis of said container are substantially in registration with one another, said chamber is rotatable to register with said port means.

2. A dispensing shower head of claim 1 comprising an enclosure for attachment to a water supply, said enclosure having an influent opening and an effluent opening, a flow path being provided between said influent and said effluent opening in said enclosure, a shower spray on said effluent opening, a container positioned in said flow path and secured to said enclosure, said container having side walls and an end wall positioned opposite said influent opening, said container also having an opening accessible through said enclosure, first port means in said container, said first port means opening into said flow path, second port means in said container, said second port means opening into said flow path, a cartridge removably insertable in said container through said container opening, a first chamber in said cartridge registerable with said first port means, a second chamber in said cartridge registerable with said second port means, said first port means and said second port means and said first chamber and said second chamber being arranged so that when said first port means is in registration with said first chamber, said second port means is not in registration with said second chamber and said container side walls seal off said second chamber from said flow path and further when said second port means is in registration with said second chamber, said first port means is not in registration with said first chamber and said container side walls seal off said first chamber from said flow path, said container is cylindrically shapped and said container is positioned in said enclosure so that the longitudinal axis of said container passing through said container end wall and said container opening is substantially parallel to said flow path, said first port means and said second port means are positioned in the side wall of said container, said cartridge is cylindrically shaped and rotatably mounted in said container so that the longitudinal axis of said cartridge and the longitudinal axis of said container are substantially in registration with one another, said first chamber is rotatable to register with said first port means and said second chamber is rotatable to register with said second port means.

3. The dispensing shower head of claim 2 where said first chamber extends through said cartridge into two first chamber openings in said cartridge, said second chamber extends through said cartridge into two second chamber openings in said cartridge, said first port means comprises openings registerable with said two first chamber openings and said second port means comprise openings registerable with said two second chamber openings.

4. The dispensing shower head of claim 3 where said first chamber is positioned axially in back of said second chamber.

5. The dispensing shower head of claim 4 where said first chamber is in a first section of said cartridge detachably securable to a second section of said cartridge containing said second chamber.

6. The dispensing shower head of claim 5 further comprising indicator means on said cartridge for indicating when said first port means and said first chamber are in registration and for indicating when said second port means and said second chamber are in registration.

7. The dispensing shower head of claim 6 where said indicator means comprise a reference marker on the face of said cartridge facing said container opening, said reference marker being rotatable to reference point means on said closure.

* * * * *